US010130861B2

(12) United States Patent
Schirmer

(10) Patent No.: US 10,130,861 B2
(45) Date of Patent: Nov. 20, 2018

(54) BALL TOSS GAME AND METHOD OF PLAYING

(71) Applicant: Robert Schirmer, East Amherst, NY (US)

(72) Inventor: Robert Schirmer, East Amherst, NY (US)

( * ) Notice: Subject to any disclaimer, the term of this patent is extended or adjusted under 35 U.S.C. 154(b) by 0 days.

(21) Appl. No.: 15/355,694

(22) Filed: Nov. 18, 2016

(65) Prior Publication Data

US 2018/0071603 A1 Mar. 15, 2018

Related U.S. Application Data

(60) Provisional application No. 62/394,731, filed on Sep. 14, 2016.

(51) Int. Cl.

| | |
|---|---|
| ***A63B 63/00*** | (2006.01) |
| ***A63B 67/06*** | (2006.01) |
| ***A63B 43/00*** | (2006.01) |
| ***A63B 63/08*** | (2006.01) |
| *A63B 37/08* | (2006.01) |
| *A63B 71/06* | (2006.01) |

(52) U.S. Cl.

CPC ..... *A63B 67/06* (2013.01); *A63B 43/00* (2013.01); *A63B 63/08* (2013.01); *A63B 43/008* (2013.01); *A63B 63/00* (2013.01); *A63B 2037/082* (2013.01); *A63B 2043/001* (2013.01); *A63B 2071/0694* (2013.01)

(58) Field of Classification Search

CPC ..... A63B 63/00; A63B 63/08; A63B 67/06

USPC ..... 273/398–402

See application file for complete search history.

(56) References Cited

U.S. PATENT DOCUMENTS

| | | | | |
|---|---|---|---|---|
| 2,021,989 A | | 11/1935 | De Master | |
| 3,495,830 A | * | 2/1970 | Farrelli | A63F 9/0204 273/317 |
| 3,578,320 A | * | 5/1971 | Goldfarb | A63F 7/02 273/120 R |
| 4,392,653 A | * | 7/1983 | Blume, Sr. | A63B 67/06 273/400 |
| 4,726,592 A | * | 2/1988 | Callaham | A63B 63/08 273/342 |
| 4,938,485 A | | 7/1990 | Hockridge | |
| 5,052,693 A | * | 10/1991 | Hicks | A63B 67/06 273/336 |
| 5,123,656 A | * | 6/1992 | Green | A63B 67/06 273/400 |

(Continued)

*Primary Examiner* — Mark Graham

(74) *Attorney, Agent, or Firm* — Vincent G. LoTempio; Kloss, Stenger & LoTempio; David T. Stephenson

(57) ABSTRACT

A ball toss game and method of playing enables multiple players that form two teams to take turns tossing two sets of uniquely colored or patterned balls into two silos positioned at a predetermined distance from each other, and then award points for a final ball thrown into a top position of the silo. Two sets of balls having unique color or patterns are tossed into the receiving opening of silo. As balls are tossed into the silos, a stacked arrangement forms until final ball is tossed into a top position of stacked arrangement. Points are awarded to the team having the final ball in the top position. The silos have a top funnel forming a receiving opening, a bottom base, and a tube extending between top funnel and bottom base. A restriction member block and releases the balls from falling into the bottom base to be retrieved.

15 Claims, 5 Drawing Sheets

(56) References Cited

U.S. PATENT DOCUMENTS

| | | | | |
|---|---|---|---|---|
| 5,290,040 | A | 3/1994 | Boroski | |
| 5,611,541 | A | 3/1997 | Paino | |
| 5,632,490 | A * | 5/1997 | Brown | A63F 7/048 273/138.3 |
| 5,707,062 | A | 1/1998 | Perillo | |
| 5,772,543 | A * | 6/1998 | Paino | A63B 37/02 273/DIG. 30 |
| 6,843,478 | B1 * | 1/2005 | Hoepelman | A63B 63/00 273/342 |
| 8,403,327 | B2 * | 3/2013 | Fischer | A63F 7/02 273/144 R |
| 9,320,953 | B2 * | 4/2016 | Belete | A63B 67/066 |
| 9,724,579 | B1 * | 8/2017 | Allen | A63B 67/06 |
| 9,789,387 | B2 * | 10/2017 | Shea | A63F 9/0204 |

* cited by examiner

BALL TOSS GAME AND METHOD OF PLAYING

CROSS REFERENCE OF RELATED APPLICATIONS

This application claims the benefits of U.S. provisional application No. 62/394,731, filed Sep. 14, 2016 and entitled "ON TOP" INDOOR/OUTDOOR RECREATIONAL GAME, which provisional application is incorporated by reference herein in its entirety.

FIELD OF THE INVENTION

The present invention relates generally to a ball toss game and method of playing. More so, the present invention relates to a ball toss game that can be played indoors or outdoors, and that requires multiple players on two teams to take turns throwing two sets of uniquely colored or patterned balls into two silos and awarding points for a final ball thrown into a top position in the silo; whereby the silos are defined by a wide top funnel that forms an opening, a narrow bottom base, a tube extending between the top funnel and the bottom base, and a restriction member that block and releases the balls from falling into the bottom base so as to be retrieved; whereby each team has a ball defined by a unique color; whereby the teams take turns throwing the balls into the silo creating a stacked arrangement of balls until a top position in the stacked arrangement receives a ball; whereby the team with the ball at the top position of the silo receives points; and whereby two different point awarding adaptations of the ball toss game determine a total number of points as a winning score.

BACKGROUND OF THE INVENTION

The following background information may present examples of specific aspects of the prior art (e.g., without limitation, approaches, facts, or common wisdom) that, while expected to be helpful to further educate the reader as to additional aspects of the prior art, is not to be construed as limiting the present invention, or any embodiments thereof, to anything stated or implied therein or inferred thereupon.

In general, object tossing games require some space and are generally best suited for outdoor activity rather than in the living room. These types of games are known using various types of missiles, such as balls, bean bags, Frisbees, horse shoes, or bolas. In playing, a pair of targets having openings are positioned in a spaced-apart location. A target, adjacent each of the openings in the box, receives the tossed ball and directs the same into such openings.

Such tossing games test the skill of each player to aim, throw or roll, and properly land rings, balls, or other objects in relationship to each other or to other objects or surroundings. Examples of such games include lawn bowling, horseshoes, bocce ball, and croquet. Though each of these games provide entertainment, each requires either a large amount of playing space which must usually be outdoors, a playing area of a particular nature, or several game pieces which are often cumbersome or inconvenient to carry.

Other proposals have involved ball tossing games. The problem with these is that they do not award points for having a final ball on top. Also, they cannot be played both indoors and outdoors. Even though the above cited ball tossing games meet some of the needs of the market, a ball toss game that can be played indoors or outdoors, and that requires multiple players on two teams to take turns throwing two sets of uniquely colored or patterned balls into two silos and awarding points for a final ball thrown into a top position in the silo is still desired.

SUMMARY

Illustrative embodiments of the disclosure are generally directed to a ball toss game and method of playing. The ball toss game is configured to enable multiple players that form two teams take turns tossing two sets of uniquely colored or patterned balls into two silos, and then award points for a final ball thrown into a top position in the silo. The silos are positioned at a predetermined distance from each other while playing the ball toss game. As the balls are tossed into the silos, the balls form a stacked arrangement until a final ball is tossed into a top position of the stacked arrangement in each silo; whereby points are awarded to the team having the final ball in the top position.

In some embodiments, the ball toss game provides two silos that are configured to enable playing the ball toss game either indoors or outdoors. The silos are defined by a top funnel that forms a receiving opening, a bottom base that forms a catch for catching and accessing the balls. A tube having a top end and a bottom end extends between the top funnel and the bottom base. The tube may be comprised of four spaced-apart struts that retain the balls in a stacked arrangement, while also allowing visibility of the balls. A restriction member, such as a pin, is disposed between the bottom end of the tube and the bottom base. The restriction member is configured to selectively regulate the path between the tube and the bottom base by moving in and out of the path between the tube and the bottom base through an aperture in the bottom end of the tube.

The ball toss game further comprises two sets of balls that are configured to be tossed into the wide top funnel of the silo. The balls are defined by an outer skin and an inner granular filling that substantially fills the outer skin. The outer skin for each set of balls is defined by a unique color or pattern. In this manner, each team has a set of balls with a unique color to prevent confusion. A predetermined number of tosses are allowed for each team. The balls form a stacked arrangement inside the tube, with a top position, e.g., the last ball that can be tossed into the tube, achieving points for the team that tosses the ball in the top position of the stacked arrangement of balls.

In some embodiments, the game requires multiple players on two teams to take turns throwing two sets of balls into two silos. Each team has a set of balls defined by a unique color or pattern. The teams take turns throwing the balls into the silo, with a predetermined number of tosses being allowed for each team. The balls tossed into the opening of the silo form a stacked arrangement of balls.

The last ball that can be tossed into the tube sets on a top position. The team with the ball at the top position of the silo receives points. Multiple point awarding adaptations of the game determine a total number of points as a winning score of the game. After each round of play, the team with the ball in the top position of the stacked arrangement is the winner of the round; and thereby awarded two points for the top position ball, and one point for each of their additional balls tossed into the tube to form the stacked arrangement. The opposing team is not awarded points for the round. At the end of each round, the restriction member is displaced away from the path in the tube and the balls are collected in the bottom base.

In some embodiments, the method for playing the ball toss game comprises an initial Step of providing two silos and two sets of balls for playing a ball toss game, the two sets of balls defined by a unique color or pattern.

Another Step may include positioning the two silos at a predetermined distance from each other.

Another Step may include selecting multiple players to form two teams.

A Step may include positioning a player from each team adjacent to the two silos.

Another Step comprises determining a total number of points as a winning score of the ball toss game.

A Step may include tossing, in sequential order by each player, the balls into an opening in the silo, whereby a predetermined number of tosses are allowed.

A Step may further comprise forming a stacked arrangement of balls in the silo.

Yet another Step may include tossing a ball into a top position in the stacked arrangement, whereby the team having the ball in the top position is awarded points; and In some embodiments, a Step may include awarding points to the team having a final ball in the top position.

A final Step comprises displacing a restriction member from the path of a tube to enable collection of the balls.

One objective of the ball toss game is to provide a game for recreational purposes and a friendly competition between teams or individuals.

Another objective is to provide a ball toss game that can be played both indoors and outdoors.

Another objective is to provide a wide top funnel that provides a target for the ball.

Another objective is to provide uniquely colored or patterned balls for each team.

Another objective is to provide ball with a granular filling that deadens impact.

Another objective is to provide a restriction member to selectively restrain the balls in stacked arrangement and release the balls to the bottom base after each round.

Another objective is to provide a ball toss game that has few rules and is easy to understand.

Another objective is to provide a ball toss game that requires a high degree of manual skill and dexterity to accomplish.

Yet another objective is to provide a ball toss game that is of a durable and reliable construction.

Yet another objective is to provide a ball toss game that may be easily and efficiently manufactured and marketed.

Other systems, devices, methods, features, and advantages will be or become apparent to one with skill in the art upon examination of the following drawings and detailed description. It is intended that all such additional systems, methods, features, and advantages be included within this description, be within the scope of the present disclosure, and be protected by the accompanying claims and drawings.

BRIEF DESCRIPTION OF THE DRAWINGS

The invention will now be described, by way of example, with reference to the accompanying drawings, in which.

Like reference numerals refer to like parts throughout the various views of the drawings.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower." "left," "rear," "right," "front." "vertical." "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Specific dimensions and other physical characteristics relating to the embodiments disclosed herein are therefore not to be considered as limiting, unless the claims expressly state otherwise.

A ball toss game 100 and method 200 of playing is referenced in FIGS. 1-7. Ball toss game 100, hereafter "game 100" is a unique indoor or outdoor game of physical dexterity and recreation that allows two teams having multiple players to take turns tossing two sets of uniquely colored or patterned balls 122*a*-*c*, 124*a*-*c* into multiple silos 102*a*. 102*b*. Balls 122*a*-*c*, 124*a*-*c* that are tossed into the silos 102*a*, 102*b* form a stacked arrangement until a final ball 124*c* is tossed into a top position of the stacked arrangement in each silo 102*a*. 102*b*. Different adaptations of points are awarded to the team that tosses the final ball 124*c* in the top position.

In some embodiments, game 100 requires multiple players 144*a*-*b*. 146*a*-*b* on two teams to take turns throwing two sets of balls 122*a*-*c*, 124*a*-*c* into multiple silos 102*a*. 102*b*. In one embodiment, two silos 102*a*, 102*b* are used. Though a single silos may be utilized in other embodiments. Each team has a set of balls 122*a-c*, 124*a-c*, which are defined by a unique color or pattern. For example, a first set of balls 122*a*, 122*b*, 122*c* are blue, and a second set of balls 124*a*. 124*b*, 124*c* are red. The teams 144*a-b*. 146*a-b* take turns throwing the balls 122*a-c*, 124*a-c* into the silo 102*a*. 102*b*, with a predetermined number of tosses being allowed for each team.

Figure 1:
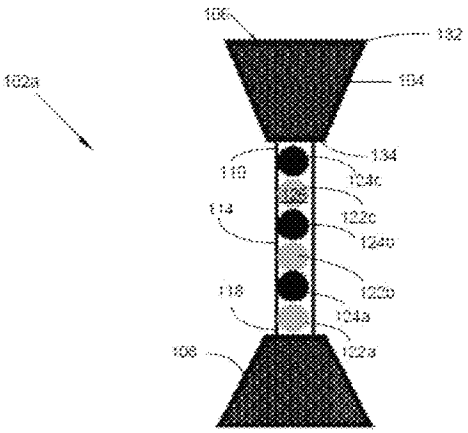
FIG. 1 illustrates a perspective view of a silo for a ball toss game, where a tube contains two sets of balls in a stacked arrangement, in accordance with an embodiment of the present invention.

As shown in FIG. 1, balls 122*a-c*. 124*a-c* tossed into the opening of silos 102*a*. 102*b* form a visible, stacked arrangement in silos 102*a*. 102*b*. The final ball 124*c* tossed into the tube 114 sets on a top position. The team with the final ball 124*c* at the top position of the silo 102*a* receives points. Multiple point awarding adaptations of the game 100 determine a total number of points as a winning score for each round of the game 100.

Figure 2:
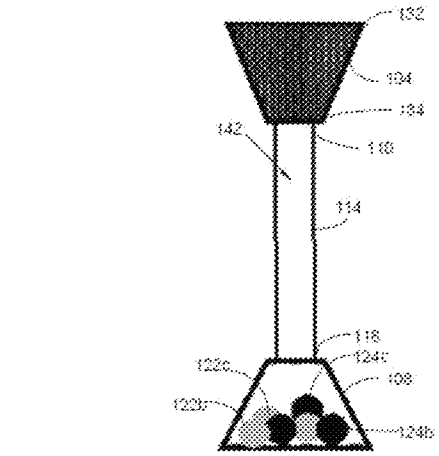
FIG. 2 illustrates a perspective view of the shown in FIG. 1, where the balls are released to a bottom base of the silo, in accordance with an embodiment of the present invention.

After each round of play, the team with a final ball 124*c* in the top position of the stacked arrangement is the winner of the round; and thereby awarded two points for the top position ball, and one point for each of their additional balls 122*a-c*. 124*a-c* tossed into the tube 114 in the stacked arrangement. Conversely, the opposing team is not awarded points for the round. At the end of each round, the restriction member is displaced from the path of the tube and the balls fall into the bottom base. FIG. 2 illustrates balls 122*a-c*. 124*a-c* released into a bottom base 108.

As referenced in FIG. 1, silo 102*a* is generally elongated and vertically disposed. Silo is configured to provide a challenging target for tossing the ball into. Silo 102*a* also arranges the balls 122*a-c*, 124*a-c* in a stacked configuration, including receiving a final ball 124*c* in a top position that determines the winner for each round of the game 100. In one embodiment of playing the game 100, two silos 102*a*. 102*b* are utilized in a spaced-apart relationship at a predetermined distance from each other. Silos 102*a*, 102*b* are also configured to mount in a vertical disposition both indoors and on an outdoor surface.

Figure 3:
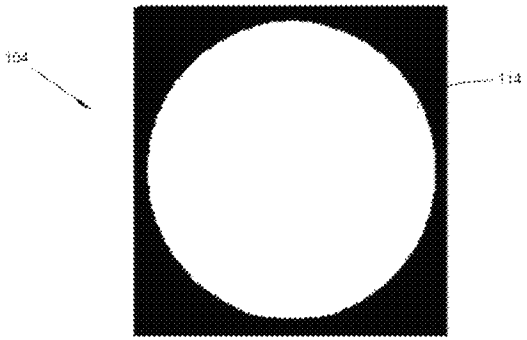
FIG. 3 illustrates a top view of the top funnel, in accordance with an embodiment of the present invention.

Looking at FIG. 3, silo 102*a*, 102*b* may be defined by a top funnel 104 having a top funnel sidewall 138 that forms a receiving opening 106. Top funnel 104 is generally the upper end of the silo 102*a*, 102*b*, above a ground surface and providing the general area of target for tossing balls 122*a-c*, 124*a-c*. In some embodiments, top funnel 104 may have a trapezoidal, or conical frustum shape with a wide mouth 132 and a narrow neck 134 that are in communication with each other to receive and allow passage of balls 122*a-c*, 124*a-c*. The dimensions of silos 102*a*, 102*b* are scalable and may be adjusted to accommodate different sizes of balls and styles of playing.

The receiving opening 106 that forms in mouth 132 is sized and dimensioned to receive a ball 122*a*, as described below. Though in other embodiments, different angles may be used.

Figure 4B:
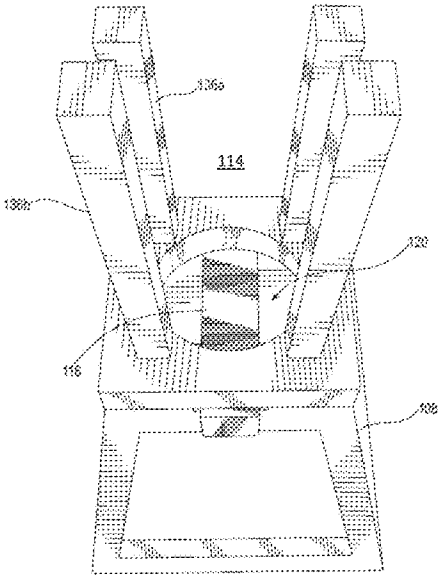
FIGS. 4A and 4B illustrate a top perspective view of the tube formed between the four struts and the restriction member, which in FIG. 4A is shown removed from the path of the balls and in FIG. 4B is shown blocking the path of the balls, in accordance with an embodiment of the present invention.
Figure 4A:
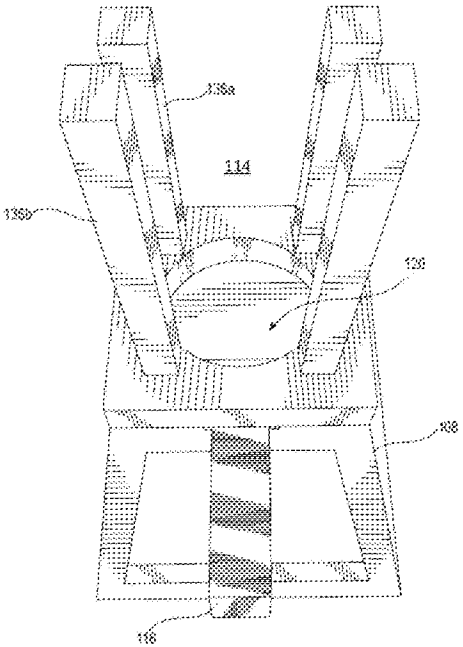

As illustrated in FIG. 4, silo 102*a*, 102*b* may further be defined by a bottom base 108 that positions opposite the top funnel 104. Bottom base 108 forms a ground surface for supporting a stacked arrangement of balls 122*a-c*. 124*a-c*. Bottom base 108 forms an open base that enables passage of the balls 122*a-c*, 124*a-c* dispensed from the tube 114. Bottom base 108 may have a generally trapezoidal shape with a square base.

Silo 102*a* further comprises a tube 114 that extends between top funnel 104 and bottom base 108 of the silo. Tube 114 comprises a top end 110 that joins with top funnel 104, and a bottom end 118 that joins with bottom base 108. The attachments may include a friction fit mating relationship, or a plurality of fasteners that couple the components together. Bottom end 118 of tube 114 may form an aperture 120 to enable passage of a restriction member 116, described below.

Figure 5:
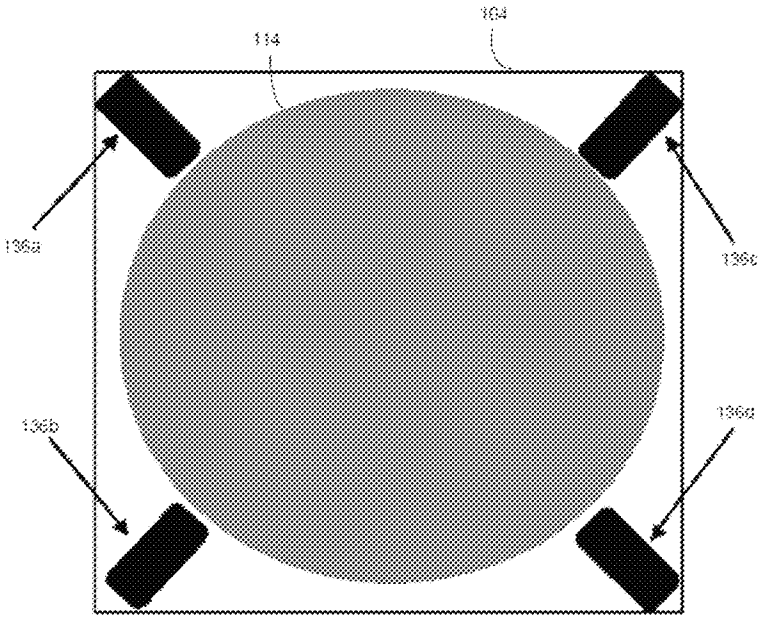
FIG. 5 illustrates a top view of the silo with four vertical struts forming the tube, in accordance with an embodiment of the present invention.

As illustrated in FIG. 5, tube 114 is comprised of four spaced-apart struts 136*a*, 136*b*, 136*c*, 136*d* that retain the balls 122*a-c*. 124*a-c* in a stacked arrangement. The vertically disposed struts 136*a*, 136*b*, 136*c*, 136*d* are configured to restrain the balls 122*a-c*, 124*a-c* in the elongated cavity 142 while also enabling visibility of balls 122*a-c*, 124*a-c*. In alternative embodiments, more, or less than four struts may be used, or a different construction design that provides structural support, vertical orientation of the balls within the silo, and ball visibility.

In one embodiment, tube 114 is generally rectangular in shaped. But in other embodiments, tube 114 is cylindrical. Tube 114 is defined by an elongated cavity 142 that is sized and dimensioned to enable passage and stacking of the balls 122*a-c*. 124*a-c*. In one embodiment, tube 114 is about 22" long. In another embodiment, tube 114 has a diameter of about 3.5". Though in other embodiments, other dimensions for the height and diameter of the tube 114, or the ball diameter may be possible, depending on the scale of the game 100 and the type of materials used to fabricate tube 114. Suitable materials for tube 114 may include, without limitation, high density polyethylene, a rigid polymer, wood, glass, silicone, and metal.

Looking back at FIG. 4, a restriction member 116, such as a pin, is disposed between the bottom end 118 of tube 114 and bottom base 108. Restriction member 116 is configured to selectively regulate the path between elongated cavity 142 of tube 114 and the bottom base 108 by moving in and out of the path between the tube 114 and the bottom base 108 through an aperture 120 that forms in the bottom end 118 of tube 114. In one embodiment, restriction member 116 is a pin. Though in alternative embodiments, restriction member 116 may include a platform or a net. In any case, restriction member 116 regulates arrangement of balls in tube 114.

Game 100 provides two silos 102*a*, 102*b* that are configured to enable playing the ball toss game 100 either indoors or outdoors.

Game 100 further comprises two sets of balls 122*a-c*, 124*a-c* that are configured to be tossed into the wide mouth 132 of top funnel 104. In one embodiment, each set of balls 122*a-c*. 124*a-c* has three balls. Balls 122*a-c*. 124*a-c* are defined by an outer skin 126 and an inner granular filling that substantially fills the outer skin 126. Outer skin 126 for each set of balls 122*a-c*, 124*a-c* is defined by a unique color or pattern. In this manner, each team has a set of balls 122*a-c*, 124*a-c* with a unique color to prevent confusion.

In some embodiments, the balls 122*a-c*, 124*a-c* may include a granular filling inside the outer skin 126 that helps to deaden impact with the ground or silo 102*a*. 102*b*. For example, granular fillings, such as corn, rice, bean, or pellets may fill a leather, woven or nonwoven outer skin 126 material. In other embodiments, balls may be constructed with any material that provides a deadened affect when contacting the silo or ground.

In use of the silos and balls 122*a-c*, 124*a-c*, a predetermined number of tosses of the balls 122*a-c*. 124*a-c* into the receiving opening 106 of the silos are allowed for each team. The balls 122*a-c*. 124*a-c* form a stacked arrangement inside the tube 114, with a top position being defined as a final ball 124*c* that can be tossed into the tube 114. The team that tosses the final ball 124*c* on the top position of the stacked arrangement of balls 122*a-c*, 124*a-c* is awarded points.

Figure 6:
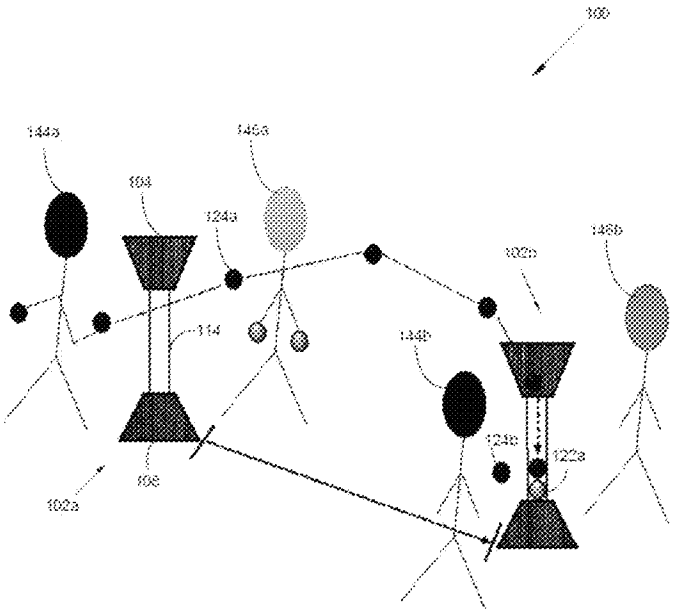
FIG. 6 illustrates a perspective view of players tossing balls into two silos, in accordance with an embodiment of the present invention.

In one exemplary embodiment of the game 100 shown in FIG. 6, two sets of balls 122*a-c*. 124*a-c* and two silos 102*a*,

102*b* are provided. The two silos 102*a*. 102*b* are positioned at a predetermined distance from each other while playing the game 100. There may be three balls 122*a-c*, 124*a-c* per set of balls, with each set of balls 122*a-c*, 124*a-c* being identified by a unique color or pattern. For example, a first team 144*a-b* has a blue set of balls 122*a-c*, 124*a-c* while a second team 146*a-b* has a red set of balls 122*a-c*, 124*a-c*. The two silos 102*a*, 102*b*, are situated at a predetermined distance from each other. Tube 114 extends down vertically from the top funnel 104 to the bottom base 108 of silo 102*a*, 102*b*.

Silos 102*a*, 102*b* can also be used outdoors.

In playing, each team 144*a-b*, 146*a-b* has a set of balls 122*a-c*, 124*a-c* distinguished by a unique color or pattern. Players 144*a*, 144*b*. 146*a*, 146*b* from each team alternate tossing the balls 122*a-c*. 124*a-c* through the air, attempting to place their ball into the receiving opening 106 in the top funnel 104 of the silo 102*a*, 102*b*. Players position at opposite silos 102*a*, 102*b* to attempt the tosses. Silos 102*a*, 102*b* are situated at a predetermined distance from each other. As balls 122*a-c*, 124*a-c* are tossed into the tube 114, a stacked arrangement of balls 122*a-c*, 124*a-c* forms.

At the end of each round the team with a final 124*c* ball in the top position of the stacked arrangement, is considered the winner of the round and is awarded two points for having the final ball 124*c* on top, and one point for each of their additional ball tossed into tube 114. The other team is not awarded points for the round. The player or team who earns the total number of points of the winning score first wins the game 100. In one possible embodiment, game 100 continues until one team reaches 25 points, but no more than 26.

In one alternative embodiment of scoring, the winner of the round is also awarded a point for each one of the opposing team's balls 122*a-c* in tube 114. In yet another alternative embodiment of game 100, the body of a teammate may be used to ricochet the ball into the opening of tube 114. However the player used as a ricochet cannot hold or guide the ball in its path of travel. Variations of the game 100 can also be created by individual owners of the game 100.

Figure 7:
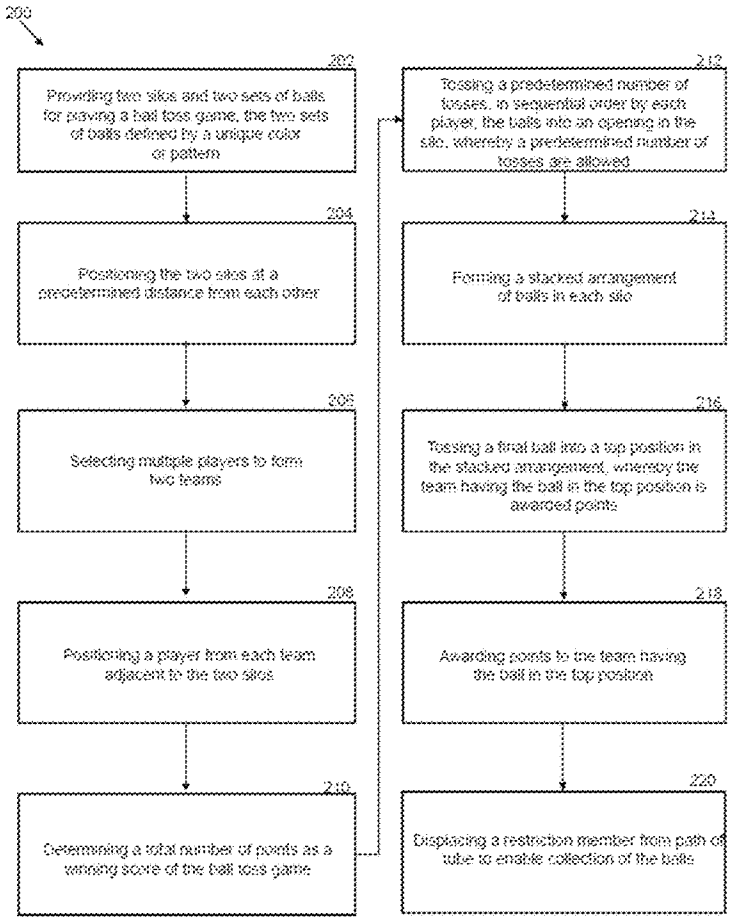
FIG. 7 illustrates a flowchart for an exemplary method for playing a ball toss game, in accordance with an embodiment of the present invention.

FIG. 7 illustrates a flowchart for an exemplary method 200 for playing a ball toss game 100. The method 200 comprises an initial Step 202 of providing two silos and two sets of balls 122*a-c*, 124*a-c* for playing a ball toss game 100, the two sets of balls 122*a-c*. 124*a-c* defined by a unique color or pattern. Another Step 204 may include positioning the two silos at a predetermined distance from each other. Silos are placed at a predetermined position from each other, such as between 10 to 30 feet. Another Step 206 may include selecting multiple players to form two teams. The game is intended to be played by 2-4 players.

A Step 208 may include positioning a player from each team adjacent to the two silos. Another Step 210 comprises determining a total number of points as a winning score of the ball toss game 100. In one possible scoring version, the team with a final 124*c* ball in the top position of the stacked arrangement, is considered the winner of the round and is awarded two points for having final ball 124*c* on top, and one point for each of their additional ball tossed into tube 114. The other team is not awarded points for the round. A Step 212 may include tossing a predetermined number of tosses, alternating tosses by each player, the balls 122*a-c*, 124*a-c* into an opening in the silo, whereby a predetermined number of tosses are allowed.

A Step 214 may further comprise forming a stacked arrangement of balls 122*a-c*, 124*a-c* in the silo. Tube is sufficiently sized to enable free passage of balls 122*a-c*, 124*a-c*, while maintaining a single linear formation of balls 122*a-c*, 124*a-c*. Yet another Step 216 may include tossing a final ball 124*c* into a top position in the stacked arrangement. Another Step 218 may include awarding points to the team having a final ball 124*c* in the top position. A final Step 220 comprises displacing a restriction member from path of tube to enable collection of the balls. Restriction member 116 pass through aperture to block path between bottom end 118 of tube 114 and bottom base 108. In one embodiment, pulling restriction member 116 enables balls 122*a-c*, 124*a-c* to fall into bottom base 108.

These and other advantages of the invention will be further understood and appreciated by those skilled in the art by reference to the following written specification, claims and appended drawings.

Because many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalence.

What is claimed is:

1. A ball toss game, the game comprising:

at least one silo defined by a top funnel forming a receiving opening, a bottom base, and a tube having an elongated cavity and extending between the top funnel and the bottom base, the tube comprising a top end joined with the top funnel, the tube further comprising a bottom end joined with the bottom base, whereby the top funnel and the bottom base are in communication;

a restriction member disposed between the bottom end of the tube and the bottom base, the restriction configured to regulate the path between the tube and the bottom base; and multiple sets of balls, the multiple sets of balls configured to be tossed into the receiving opening of the top funnel of the at least one silo, whereby the multiple sets of balls form a single stacked arrangement in the elongated cavity of the tube, whereby a final ball positions on top of the single stacked arrangement, whereby placing the restriction member between the bottom end of the tube and the bottom base restricts the multiple sets of balls from moving to the bottom base, and whereby displacing the restriction member away from the bottom end of the tube and the bottom base enables the multiple sets of balls to move to the bottom base.

2. The game of claim 1, wherein the top funnel comprises a top funnel sidewall, a wide mouth, and a narrow neck.

3. The game of claim 2, wherein the mouth is configured to receive the multiple sets of balls.

4. The game of claim 1, wherein the at least one silo comprises two silos, wherein the two silos are positioned at a predetermined distance from each other.

5. The game of claim 1, wherein the tube having the elongated cavity comprises spaced-apart struts to provide structural support for the silos and to provide a vertically stacked orientation of balls for the purpose of awarding points.

6. The game of claim 1, wherein the bottom end of the tube comprises an aperture configured to enable passage of the restriction member.

7. The game of claim 1, wherein the restriction member is disposed generally perpendicular to the tube.

8. The game of claim 1, wherein the restriction member is a pin, or plate, wherein said pin or plate is displaced after each set of balls has been tossed, whereupon all balls contained in the silos are released into the bottom base.

9. The game of claim 1, wherein the bottom base comprises an open frame that enables access to the multiple sets of balls.

10. The game of claim 1, wherein each ball is defined by a granular filling and an outer skin configured to encapsulate the granular filling.

11. A ball toss game, the game comprising:

at least one silo defined by a top funnel forming a receiving opening, a bottom base, and a tube having an elongated cavity and extending between the top funnel and the bottom base, the tube comprising a top end joined with the top funnel, the tube further comprising a bottom end joined with the bottom base, whereby the top funnel and the bottom base are in communication;

wherein the top funnel is positioned vertically above the tube and the top funnel is frustoconical;

wherein a diameter of a bottom opening in the top funnel allows for only one ball to pass through at a time, and wherein a diameter of the tube allows for only one ball to pass through at a time;

a restriction member disposed between the bottom end of the tube and the bottom base, the restriction member configured to selectively regulate the path between the tube and the bottom base; and multiple sets of balls, the multiple sets of balls configured to be tossed into the receiving opening of the top funnel of the at least one silo, whereby the multiple sets of balls form a stacked arrangement in the elongated cavity of the tube, whereby a final ball positions on top of the stacked arrangement, whereby placing the restriction member between the bottom end of the tube and the bottom base restricts the multiple sets of balls from moving to the bottom base, whereby displacing the restriction member away from the bottom end of the tube and the bottom base enables the multiple sets of balls to move to the bottom base.

12. The game of claim 11, wherein the tube is hollow and includes no obstructions from a first end at a base to a second end at a top.

13. The game of claim 11, wherein the diameter of the bottom opening of the top funnel at a connection between the top funnel is equivalent to the diameter of the top opening of the tube.

14. The game of claim 11, wherein the top funnel, the tube and the base form a symmetrical butterfly shape.

15. A projectile toss game, the game comprising:

at least one silo defined by a top funnel forming a receiving opening, a bottom base, and a tube having an elongated cavity and extending between the top funnel and the bottom base, the tube comprising a top end joined with the top funnel, the tube further comprising a bottom end joined with the bottom base, whereby the top funnel and the bottom base are in communication;

wherein the top funnel is positioned vertically above the tube and the top funnel is frustoconical;

wherein a diameter of a bottom opening in the top funnel allows for only one projectile to pass through at a time, and wherein a diameter of the tube allows for only one projectile to pass through at a time;

a restriction member disposed between the bottom end of the tube and the bottom base, the restriction member configured to selectively regulate the path between the tube and the bottom base; and multiple sets of projectiles, the multiple sets of projectiles configured to be tossed into the receiving opening of the top funnel of the at least one silo, whereby the multiple sets of projectiles form a stacked arrangement in the elongated cavity of the tube, whereby a final projectile positions on top of the stacked arrangement, whereby displacing the restriction member between the bottom end of the tube and the bottom base restricts the multiple sets of projectiles from moving to the bottom base, whereby displacing the restriction member away from the bottom end of the tube and the bottom base enables the multiple sets of projectiles to move to the bottom base.

* * * * *